US008623113B2

(12) United States Patent
Nomura et al.

(10) Patent No.: US 8,623,113 B2
(45) **Date of Patent: *Jan. 7, 2014**

(54) METAL COMPONENT COLLECTION AGENT AND METHOD FOR COLLECTING METAL COMPONENT

(75) Inventors: Katsuhiro Nomura, Ikeda (JP); Hiroyuki Kageyama, Ikeda (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 221 days.

This patent is subject to a terminal disclaimer.

(21) Appl. No.: 13/074,341

(22) Filed: Mar. 29, 2011

(65) Prior Publication Data

US 2011/0239825 A1 Oct. 6, 2011

(30) Foreign Application Priority Data

Mar. 31, 2010 (JP) ..... 2010-080150

(51) Int. Cl.
*C22B 1/00* (2006.01)
*C22B 7/00* (2006.01)
*C22B 3/08* (2006.01)

(52) U.S. Cl.
USPC ..... 75/401; 75/743

(58) Field of Classification Search
USPC ..... 75/401, 743
See application file for complete search history.

(56) References Cited

U.S. PATENT DOCUMENTS 3,645,719 A 2/1972 Minnick
4,077,800 A * 3/1978 Peka et al. ..... 75/744
4,361,442 A 11/1982 Faulring et al.
4,384,885 A * 5/1983 Muller et al. ..... 75/10.58
6,352,955 B1 3/2002 Golden (Continued)

FOREIGN PATENT DOCUMENTS

JP 52-113322 A 9/1977
JP 4-354831 A 12/1992

(Continued)

OTHER PUBLICATIONS

Kikuo Fujiwara; "Recycling of Precious Metals Catalyst"; Chemical Engineering, vol. 55, No. 1, pp. 21-24, 1991, The Society of Chemical Engineers, Japan (with partial English Translation).
International Search Report of PCT/JP2009/064819, mailing date Dec. 1, 2009.
International Search Report of PCT/JP2009/053388, mailing date Mar. 31, 2009 (w/ English Translation).

(Continued)

*Primary Examiner* — George Wyszomierski
*Assistant Examiner* — Tima M McGuthry Banks
(74) *Attorney, Agent, or Firm* — Westerman, Hattori, Daniels & Adrian, LLP

(57) ABSTRACT

The present invention provides a metal component collection agent for collecting one or more metal components from a metal component-containing material; the agent containing, as an active ingredient, a compound containing one or more group 2 elements of the periodic table, or a compound containing one or more lanthanoid elements. The present invention further provides a method for collecting one or more metal components from a metal component-containing material; the method comprising heating the metal component-containing material and the metal component collection agent in such a manner that a metal vapor or metal oxide vapor produced by heating the metal component-containing material is brought into contact with the metal component collection agent. According to the present invention, metal components can be easily and efficiently collected from materials containing highly useful metal components such as noble or rare metal.

4 Claims, 7 Drawing Sheets

(56) References Cited

U.S. PATENT DOCUMENTS

| | | | | |
|---|---|---|---|---|
| 6,497,851 | B1 | 12/2002 | Hu et al. | |
| 6,905,989 | B2 | 6/2005 | Ellis et al. | |
| 7,157,405 | B2 | 1/2007 | Suzuki et al. | |
| 8,048,194 | B2 * | 11/2011 | Rathweg | 75/401 |
| 2001/0010181 | A1 | 8/2001 | Zasowski et al. | |
| 2009/0253574 | A1 * | 10/2009 | Tanaka et al. | 502/303 |
| 2010/0080744 | A1 * | 4/2010 | Schmidt et al. | 423/22 |
| 2011/0017022 | A1 * | 1/2011 | Date et al. | 75/711 |
| 2011/0192255 | A1 * | 8/2011 | Nomura et al. | 75/743 |

FOREIGN PATENT DOCUMENTS

| | | | |
|---|---|---|---|
| JP | 06-025758 | A | 2/1994 |
| JP | 2005-257175 | A | 9/2005 |
| JP | 2007-51035 | A | 1/2007 |
| JP | 2008-100902 | A | 1/2008 |
| JP | 2008-001916 | A | 10/2008 |
| WO | 2007/138807 | A1 | 12/2007 |

OTHER PUBLICATIONS

US Final Office Action dated Apr. 29, 2013, issued in U.S. Appl. No. 12/919,724.

Date et al., "Unique Catalytic Activity of Platinum Eluted into Perovskite in the Solid Phase", Catalysios Letters, Sep. 2007, vol. 117, Nos. 3-4, pp. 107-111.

US Non-Final Office Action dated Mar. 26, 2013, issued in U.S. Appl. No. 13/122,865.

Nomura et al., Ultramarine colored: Solid-phase elution of Pt into perovskite oxides:, Journal of Materials Research, Oct. 2007, vol. 22, No. 10, pp. 2647-2650.

US Non-Final Office Action dated Dec. 12, 2012, issued in U.S. Appl. No. 12/919,724.

Date et al., "Koso Yoshutsuho de Chosei shita Hakkin-Perovskite Shokubal no Tokui Kassel (2)", Dai 100Kai CatSJ Meeting A Yokoshu, Sep. 17, 2007, 481, with English Translation.

* cited by examiner

METAL COMPONENT COLLECTION AGENT AND METHOD FOR COLLECTING METAL COMPONENT

TECHNICAL FIELD

The present invention relates to a metal component collection agent for collecting a metal component from a metal component-containing material, and a method for collecting a metal component using this metal component collection agent.

BACKGROUND ART

Noble metals and rare metals are widely used for industrial purposes for their excellent stability, catalyst activity, etc. However, because noble metals and rare metals are rare and expensive resources, effective utilization thereof is necessary. Therefore, it is important to efficiently collect and reuse noble or rare metal contained in used noble or rare metal-containing waste materials, such as waste catalysts for purifying automobile exhaust gas, waste catalysts for chemical industries, wastes generated in electronic circuit board manufacturing processes, waste electronic components, wastes of electrolysis electrode, and the like.

Typical examples of methods for collecting noble or rare metal include a wet method, such as a dissolution method comprising dissolving a metal component in a strong acid to thereby collect metal; and a dry method comprising collecting metal by absorption of a metal component into a molten metal (see Non-Patent Literature (NPL) 1). However, various waste materials, such as electronic components, battery cells, catalysts, cellular phones, and automobile parts, contain noble or rare metal etc. Therefore, whichever method, i.e., wet or dry method, is employed for the collection, formation of processes or systems suitable for the properties of each of the materials is needed.

In a wet method, acids destroy the material itself of a waste material. Therefore, even if noble metal etc. is collected, the base material thereof cannot be reused. In addition, after-treatment of the dissolved residue is troublesome. Further, in a wet method, the dissolution rate of noble or rare metal in acid is low, and a waste material containing a smaller amount of noble or rare metal requires a relatively larger amount of acid. Furthermore, because strong acids must be handled with care and may cause adverse environmental effects, an increase in equipment investment is unavoidable.

With respect to the dry method, which uses a molten metal, such as iron, copper, lead, or the like, as a material for absorbing noble or rare metal, the efficiency of noble or rare metal absorption is not so high, the devices are costly because the method is performed at a high temperature, and thus expensive equipment is required. Further, at present, using molten lead is substantially difficult because it is environmentally harmful.

CITATION LIST

Non-Patent Literature

NPL 1: Kikuo Fujiwara, "Recycling of Precious Metals Catalyst", Chemical Engineering, Volume 55, No. 1, p. 21, 1991, The Society of Chemical Engineers, Japan

SUMMARY OF INVENTION

Technical Problem

The present invention was made in view of the above-described current state of the prior art. A principal object of the present invention is to provide a method for easily and efficiently collecting a metal component from a material containing a highly useful metal component such as noble or rare metal. Another object of the present invention is to provide a metal component collection agent usable in this method.

Solution to Problem

The present inventors conducted extensive research to achieve the above-described objects, and found the following. When a compound containing a group 2 element of the periodic table or a lanthanoid element is used as a metal component collection agent, placed in one container together with a metal component-containing material, and heated, a metal component vaporized from the metal-component containing material and the group 2 element of the periodic table or lanthanoid element cause the formation of a complex metal oxide, allowing the metal component vaporized from the metal-component containing material to be occluded in the complex metal oxide. The present inventors found that the use of this phenomenon enables selective collection of metal components such as noble or rare metal components etc. from various waste materials containing metal components such as noble or rare metal components etc. The present invention was accomplished as a result of further research based on these findings.

More specifically, the present invention provides the following metal component collection agent, and method for collecting a metal component.

1. A metal component collection agent for collecting one or more metal components from a metal component-containing material, the collection agent comprising as an active ingredient a compound containing one or more group 2 elements of the periodic table, or a compound containing one or more lanthanoid elements.

2. The metal component collection agent according to Item 1, wherein the compound containing one or more group 2 elements of the periodic table is at least one compound selected from the group consisting of oxides, carbonates, nitrates, sulfates, chlorides, and alkoxide compounds, each compound of which contains at least one element selected from the group consisting of Mg, Ca, Sr, and Ba; and the compound containing one or more lanthanoid elements is at least one compound selected from the group consisting of oxides, carbonates, nitrates, sulfates, chlorides, and alkoxide compounds, each compound of which contains at least one element selected from the group consisting of La and Nd.

3. A method for collecting one or more metal components from a metal component-containing material, the method comprising heating the metal component-containing material and the metal component collection agent of Item 1 or 2, in such a manner that a metal vapor or metal oxide vapor produced by heating the metal component-containing material is brought into contact with the metal component collection agent.

4. The method according to Item 3, wherein the metal component-containing material and the collection agent of Item 1 or 2 are placed together in one container and heated.

5. The method according to Item 3 or 4, wherein the metal component-containing material is a waste material containing at least one metal element selected from the group consisting of noble metal elements and rare metal elements.

6. A method for recovering metal, comprising:

collecting one or more metal components using the method of any of Items 3 to 5;

dissolving the collected one or more metal elements in an acid; and then recovering the dissolved one or more metal elements as a solid metal.

Hereinafter, specific descriptions are given with respect to the metal component collection agent of the present invention, and the method for collecting a metal component using the metal component collection agent.

Metal Component Collection Agent

The metal component collection agent of the present invention comprises as an active ingredient a compound containing a group 2 element of the periodic table, or a compound containing a lanthanoid element. Examples of group 2 elements of the periodic table include Mg, Ca, Sr, Ba, and the like. The compound containing a group 2 element of the periodic table may contain one or more of the above-mentioned group 2 elements of the periodic table. Examples of lanthanoid elements include La, Nd, and the like. The compound containing a lanthanoid element may contain one or more of the above-mentioned lanthanoid elements.

There is no limitation to the types of compounds containing a group 2 element of the periodic table or compounds containing a lanthanoid element. As such compounds, for example, oxides, hydroxides, carbonates, nitrates, sulfates, chlorides, and like inorganic compounds; alkoxide compounds, and like organic compounds; etc. can be used. These compounds may be used singly, or in a combination of two or more.

Of these compounds, carbonates, oxides, etc. are particularly preferable because they are easily handled, and do not generate harmful substances as a result of decomposition during a heat treatment for collecting a metal component.

When a metal component-containing material is heated with the metal component collection agent of the present invention, a metal component vaporized from the metal component-containing material reacts with a compound containing a group 2 element of the periodic table or lanthanoid element contained in the collection agent to form a complex metal oxide, allowing the metal component vaporized from the metal component-containing material to be occluded in the complex metal oxide. According to this method, metal components are efficiently collected from waste materials containing various metal components, such as noble metal components, e.g., ruthenium and iridium; rare metal components, e.g., molybdenum, tungsten, rhenium, and indium; and the like.

There is no particular limitation to the forms of the compound containing a group 2 element of the periodic table and the compound containing a lanthanoid element, i.e., the active ingredients of the metal component collection agent of the present invention. It is preferable that these compounds be pulverized in a ball mill or the like, to be formed into as fine a powder as possible, so that they readily undergo reaction to form a complex oxide during the heat treatment under the conditions mentioned below. The fine powder preferably has an average particle diameter of, for example, about 100 μm or less. The compounds in powder form may also be formed into pellets. In this specification, an average particle diameter is a value calculated by a laser diffraction method.

Target to be Treated

In the method for collecting a metal component using the metal component collection agent of the present invention, a target to be treated is a metal component-containing material (hereinafter sometimes simply referred to as a "metal-containing material"). Specifically, the target to be treated may be a material that comprises a target metal component to be collected, and other components, such as metals that are not the target to be collected, oxides, nitrides, carbon materials, ceramics, organic substances, and the like. When a treatment is performed in accordance with the method mentioned below using the metal component collection agent of the present invention, the target metal component can be selectively collected from various materials comprising the target metal component to be collected, and other components. There is no limitation to the types of the target metal component to be collected, as long as it can be vaporized and exist as vapor of the metal itself, or vapor of an oxide of the metal, under the treatment conditions described below.

There is also no particular limitation to the forms and shapes of the target metal-containing material to be treated. The target metal-containing material may be, for example, in powder, mesh, wire, foil, honeycomb, or in other arbitrary form. In addition, there is no particular limitation to the state of the existence of the metal component in the target metal-containing material. For example, in the target metal-containing material, the target metal component to be collected may be in the state of a metal such as a metal elementary substance or alloy containing the metal; or in the state of a compound such as an oxide etc. that contains the metal component. When the target metal component to be collected exits as alloys with other metals, the other metals may be those having a vapor pressure lower than that of the target metal component to be collected, under the conditions in which the collection is performed.

Further, metal components in various states, such as metal or metal oxide supported on a material such as an oxide; a metal film or a metal oxide film; and the like, can be collected. The target metal-containing material may contain two or more metal components to be collected.

A collection method, which uses the metal component collection agent of the present invention, is particularly useful as a method for effectively collecting noble or rare metal components from waste materials containing noble or rare metal components as the metal component to be collected. Examples of such waste materials include waste catalysts for purifying automobile exhaust gas, waste catalysts for chemical industries, waste gas sensor boards, wastes generated in electronic circuit board manufacturing processes, waste electronic components, wastes of electrolysis electrodes, wastes generated from medical products such as dental products, and the like.

When a waste material containing at least one metal element selected from the group consisting of noble metal elements and rare metal elements is treated, the use of the metal component collection agent of the present invention enables efficient collection of noble or rare metal components not only from materials containing a large amount of noble or rare metal components, but also from materials containing only a few ppm of noble or rare metal components. Examples of the target noble metal elements and rare metal elements to be collected include metal elements in groups 6, 7, 8, 9, 13, etc., of the periodic table. Of the metal elements in these groups, the metal elements, for example, in the 5th or 6th period of the periodic table can be efficiently collected. Examples of such noble metal elements and rare metal elements include Mo, W, Re, Ru, Os, Rh, Ir, In, and the like.

Method for Collecting Metal Component

In the method of the present invention for collecting a metal component, a target metal-containing material to be treated and a metal component collection agent of the present invention are simply heated in such a manner that vapor of a metal produced from the metal-containing material or vapor of an oxide of the metal can be brought into contact with the metal component collection agent.

As a specific method, for example, the metal component collection agent of the present invention and the target metal-containing material are simply placed together in one container, and heated to at least a temperature at which metal vapor or metal oxide vapor of a metal component contained in the metal-containing material is produced. According to this method, the metal vapor or metal oxide vapor of the metal component as a constituent of the metal-containing material can be brought into contact with the metal component collection agent of the present invention. In this case, the reaction container does not have to be completely hermetically sealed insofar as the metal vapor or metal oxide vapor of the metal component contained in the metal-containing material can be sufficiently brought into contact with the metal component collection agent of the present invention. However, sealing performance should be maintained so as to prevent dissipation of the produced vapor.

The heating temperature must be at least a temperature at which the metal component contained in the metal-containing material is converted to metal vapor or metal oxide vapor. Additionally, the heating temperature must be at least a temperature at which a complex oxide is formed from the metal component contained in the metal vapor or metal oxide vapor and a group 2 element of the periodic table or lanthanoid element. The heating temperature is usually about 800° C. or higher, and lower than the decomposition temperature of the complex oxide formed. For example, the heating temperature is preferably about 1,000 to 1,700° C., more preferably about 1,200 to 1,500° C.

In the reaction container, it is sufficient if the metal vapor or metal oxide vapor produced from the metal-containing material can be brought into contact with the metal component collection agent of the present invention. The target metal-containing material and the collection agent of the present invention may be either in contact, or not in contact. For example, the following methods can be employed: a heating method in a state where the collection agent of the present invention is placed on the target metal-containing material; a heating method in a non-contact state where the metal-containing material and the metal component collection agent of the present invention are arranged at arbitrary intervals in the container; and the like.

Of these methods, the heating method in a non-contact state is advantageous for the following reasons: it does not require pretreatment such as grinding and the like to ensure the contact between the metal-containing material and the collection agent of the present invention; and the metal-containing material and the complex oxide formed from the collection agent of the present invention, are in an easily separable state, and can thus be easily separated after heating. On the other hand, when heating is performed in a contact state, the collection speed can be improved because the distance between the metal-containing material and the collection agent of the present invention is reduced.

The pressure (partial pressure) of the metal vapor or metal oxide vapor in the reaction container is not particularly limited. Usually, it is preferably about $10^{-3}$ Pa or higher, more preferably about 1 Pa or higher, and further preferably about $10^{2}$ Pa or higher.

The reaction time is not particularly limited. When the heating is performed in the above-described temperature range, the reaction time is preferably about 5 to 20 hours, and more preferably about 10 to 15 hours.

In order to help the reaction proceed more quickly, it is preferable to bring the metal vapor or metal oxide vapor having the highest possible pressure (partial pressure) into contact with the metal component collection agent of the present invention at the highest possible temperature. In order to do so, the reaction is desirably carried out in a state in which the target metal-containing material is in contact with the metal component collection agent of the present invention; and at a temperature that is lower than the decomposition temperature of a complex oxide formed from the collection agent of the present invention, and that is preferably as close to the decomposition temperature as possible.

Note that metal oxide vapor can be produced simply by the presence of oxygen in the container in which the collection agent of the present invention and the metal-containing material are placed. In this case, it is possible to produce metal oxide vapor having a prescribed pressure at a lower temperature, compared to when producing metal vapor. The partial pressure of oxygen in the container is typically about $10^{-1}$ Pa or higher, and is preferably about $10^{4}$ Pa or higher.

A metal component can be selectively collected from the target metal-containing material to be treated by the above-described method. Although the reason therefor is unclear, it is considered that, first, heating a metal-containing material causes production of metal vapor or metal oxide vapor of the target metal component to be collected; this metal vapor or metal oxide vapor reacts with a compound containing a group 2 element of the periodic table or lanthanoid element contained in the collection agent of the present invention, resulting in the formation of a complex oxide from the metal component and the group 2 element of the periodic table or lanthanoid element; and consequently, a metal element is absorbed and occluded in the product. At this time, when the metal-containing material is heated in the presence of oxygen, metal oxide vapor having a partial pressure comparable to that of a metal vapor may be produced at a lower temperature. In this case, it is considered that an environment is created in which vapor of the target metal component contained in the metal-containing material is easily produced, and the metal is efficiently occluded.

Although the type of complex oxide to be formed cannot be generally specified, there will be formed a complex metal oxide in accordance with a phase diagram (state diagram) for complex oxide comprising a metal component to be collected and a group 2 element of the periodic table or lanthanoid element contained in the collection agent of the present invention. Specific types of complex oxides to be formed vary depending on the type of collection agent used, amount of collection agent, reaction temperature, type of metal component to be collected, pressure (partial pressure) of metal vapor or metal oxide vapor, and the like. However, the amount of metal collected can be increased by employing conditions under which a complex oxide having a high proportion of metal component is formed, according to the combination of a group 2 element of the periodic table or lanthanoid element, and a metal component. Employing the above-described conditions allows occlusion of a large amount of metal component, up to about 100 atom %, when the total amount of group 2 elements of the periodic table and lanthanoid elements contained in the collection agent of the present invention is defined as 100 atom %.

Method for Dissolving and Recovering Metal

After the metal component contained in the metal-containing material is occluded in the product formed from the metal component collection agent of the present invention by the above method, the product in which the metal component is occluded is brought into contact with an acid, and the metal component can thereby be dissolved in the acid.

Examples of acids include, but are not particularly limited to, inorganic acids such as hydrofluoric acid, hydrochloric acid, nitric acid, sulfuric acid, phosphoric acid, etc.; and organic acids such as formic acid, acetic acid, etc. These acids may be used alone, or in a combination of two or more.

Examples of mixtures of acids that can be used include aqua regia and the like. Industrially, it is preferable to use hydrochloric acid, sulfuric acid, nitric acid, and the like, which are milder than aqua regia. Sulfuric acid, nitric acid, and the like are particularly preferable in terms of environmental load, because these acids do not produce chloride. Although the acid concentration used for dissolving the metal component is not limited, the concentration is preferably as high as possible in view of reaction time, dissolution efficiency, etc. However, when the acid concentration is overly high, the water concentration is relatively low. This may slow down the reaction instead, due to the production of precipitate and the like. Meanwhile, low-concentration acids are preferable in terms of environmental load. The acid concentration may be suitably determined by taking into account these points.

Although the method for bringing a product in which the metal component is occluded into contact with an acid is not particularly limited, the product is usually immersed in an acid; and the acid is heated, if necessary.

The heating temperature may be set to a temperature at which the crystal structure of a complex oxide in the product is destroyed in the acid, causing dispersion of its components in the acid, and the metal component contained in the product is dissolved as an ion in the solution. Usually, the temperature may be in the range of from room temperature to a temperature lower than the boiling point of the acid. In view of reaction time and dissolution efficiency in particular, the temperature is preferably about 30 to 100° C.

The metal component dissolved in the acid by the above method can be recovered as a solid metal by known methods such as a reduction method using a reducing agent; a recovery method by cementation with metals such as Zn and the like; a recovery method through absorption into an ion-exchange resin or activated carbon; a method in which the process from recovery to separation and refinement is carried out by a solvent extraction method; a recovery method by an electrolytic process; and the like. These methods are very useful particularly when the target to be treated is a waste material containing a rare metal component and the like, because such high value-added metal components can be efficiently reused at low cost by a simple method.

Further, the acid solution after the metal recovery contains dispersed components of the complex oxide in the form of inorganic compounds such as oxide, hydroxide, carbonate, nitrate, sulfate, chloride and the like, or organic compounds. The acid is removed from this acid solution by, for example, heating or reducing pressure, thereby allowing the above components to be collected. These collected components can be reused, as is, as the active ingredients of the metal component collection agent of the present invention in the method of the present invention for collecting a metal component.

Advantageous Effects of Invention

The present invention achieves the following significant effects:

(1) With the use of the metal component collection agent of the present invention, only the target metal component can be efficiently separated and collected by a simple method from various materials containing the target metal components, and other components.

(2) In particular, when the target to be treated is a waste material containing a noble metal component or rare metal component, such rare and valuable resources (noble metals and rare metals) can be efficiently collected by a simple method. Moreover, according to the method of the present invention, the metal component can be efficiently collected, even if the metal component content in the waste material is low.

(3) The metal component occluded in the product formed from the metal component collection agent of the present invention can be easily dissolved using various acids; afterward, the metal component can be reused as a solid metal using a known method.

(4) After the metal element is dissolved, the components contained in the acid residue can be reused, as is, as the active ingredients of the metal component collection agent of the present invention for collecting a metal. Accordingly, it is economically very useful.

MODE FOR CARRYING OUT INVENTION

The present invention is described below in more detail with reference to Examples.

Example 1

Collection of Molybdenum from Molybdenum Foil Using CaO

CaO powder (0.25 g) was placed in one of two ceramic containers, and molybdenum foil (thickness: 0.035 mm, weight: 0.4 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1300° C. for 10 hours in air, the molybdenum foil was evaporated, and colorless powder was obtained in the ceramic container that had contained CaO powder.

Figure 1:
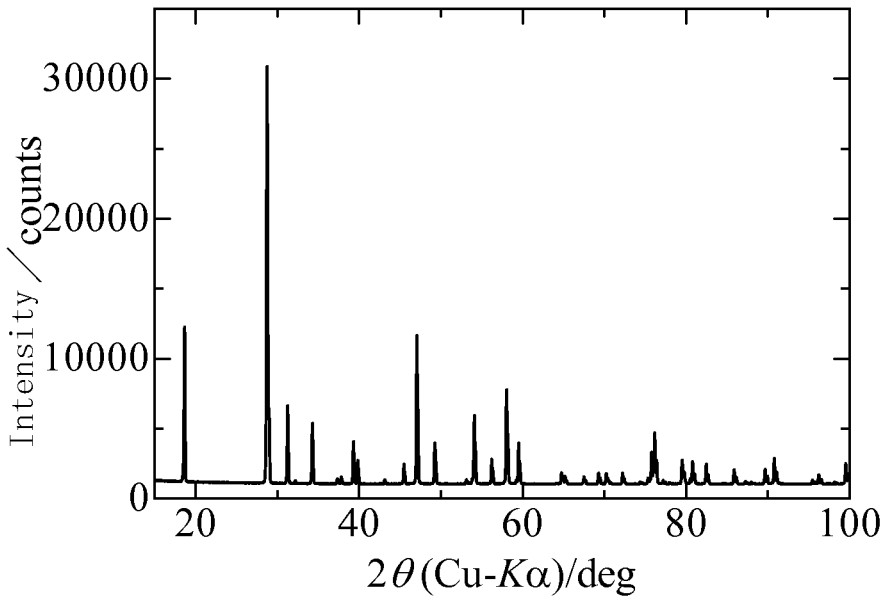
FIG. 1 An X-ray diffraction pattern of mixed powder after reaction obtained in Example 1.

FIG. 1 shows an X-ray diffraction pattern of the obtained powder, and Rietveld analysis confirmed that the powder was a mixture comprising $CaMoO_4$ and CaO at a weight ratio (%) of 98:2 ($CaMoO_4$:CaO).

The results confirmed that a product containing $CaMoO_4$, which is a molybdenum-containing complex oxide, was obtained by the above heat treatment, and that molybdenum was occluded in the product.

Example 2

Collection of Molybdenum from Molybdenum Foil Using $SrCO_3$ $SrCO_3$ powder (0.5 g) was placed in one of two ceramic containers, and molybdenum foil (thickness: 0.035 mm, weight: 0.4 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1300° C. for 10 hours in air, the molybdenum foil was evaporated, and colorless powder was obtained in the ceramic container that had contained $SrCO_3$ powder.

Figure 2:
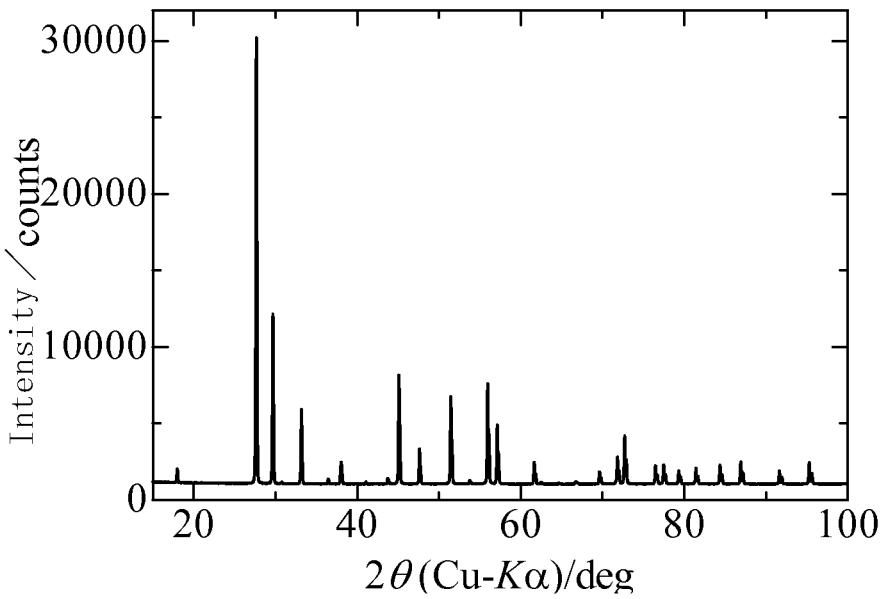
FIG. 2 An X-ray diffraction pattern of mixed powder after reaction obtained in Example 2.

FIG. 2 shows an X-ray diffraction pattern of the obtained powder, and Rietveld analysis confirmed that the powder was a mixture comprising $SrMoO_4$ and $Sr_3MoO_6$ at a weight ratio (%) of 99.8:0.2 ($SrMoO_4$:$Sr_3MoO_6$).

The results confirmed that a product containing $SrMoO_4$ and $Sr_3MoO_6$, which are molybdenum-containing complex oxides, was obtained by the above heat treatment, and that molybdenum was occluded in the product.

Example 3

Collection of Molybdenum from Molybdenum Foil Using $BaCO_3$ $BaCO_3$ powder (2 g) was placed in one of two ceramic containers, and molybdenum foil (thickness: 0.035 mm, weight: 0.4 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1300° C. for 10 hours in air, the molybdenum foil was evaporated, and yellow powder was obtained in the ceramic container that had contained $BaCO_3$ powder.

Figure 3:
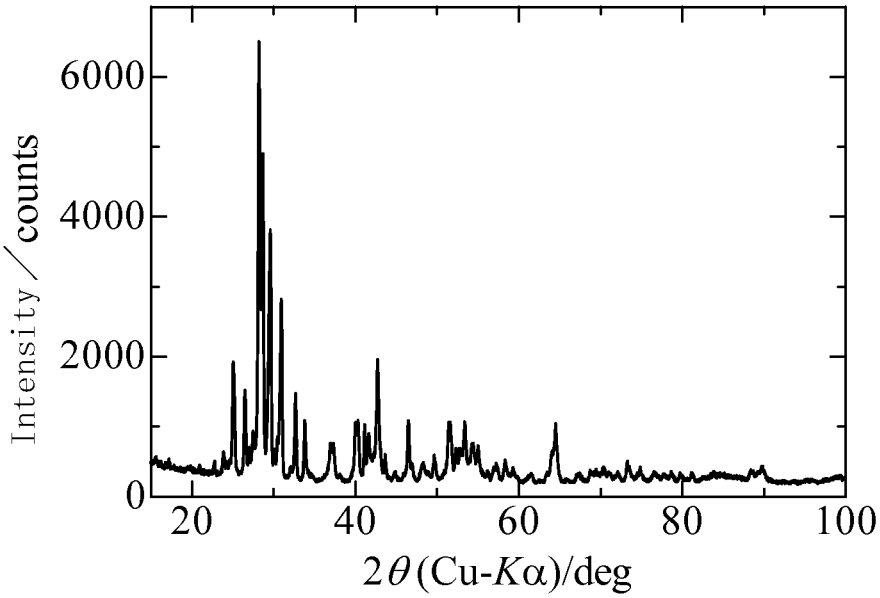
FIG. 3 An X-ray diffraction pattern of mixed powder after reaction obtained in Example 3.

FIG. 3 shows an X-ray diffraction pattern of the obtained powder, and Rietveld analysis confirmed that the powder was a mixture comprising $Ba_2MoO_5$, $BaMoO_4$, $BaMo_3O_{10}$, and $BaCO_3$ at a weight ratio (%) of 94:1:3:2 ($Ba_2MoO_5$:$BaMoO_4$:$BaMo_3O_{10}$:$BaCO_3$).

The results confirmed that a product containing $Ba_2MoO_5$, $BaMoO_4$, and $BaMo_3O_{10}$, which are molybdenum-containing complex oxides, was obtained by the above heat treatment, and that molybdenum was occluded in the product.

Example 4

Collection of Tungsten from Tungsten Foil Using CaO

CaO powder (0.8 g) was placed in one of two ceramic containers, and tungsten foil (thickness: 0.035 mm, weight: 0.3 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1375° C. for 10 hours in air, the tungsten foil was evaporated, and colorless powder was obtained in the ceramic container that had contained CaO powder.

Figure 4:
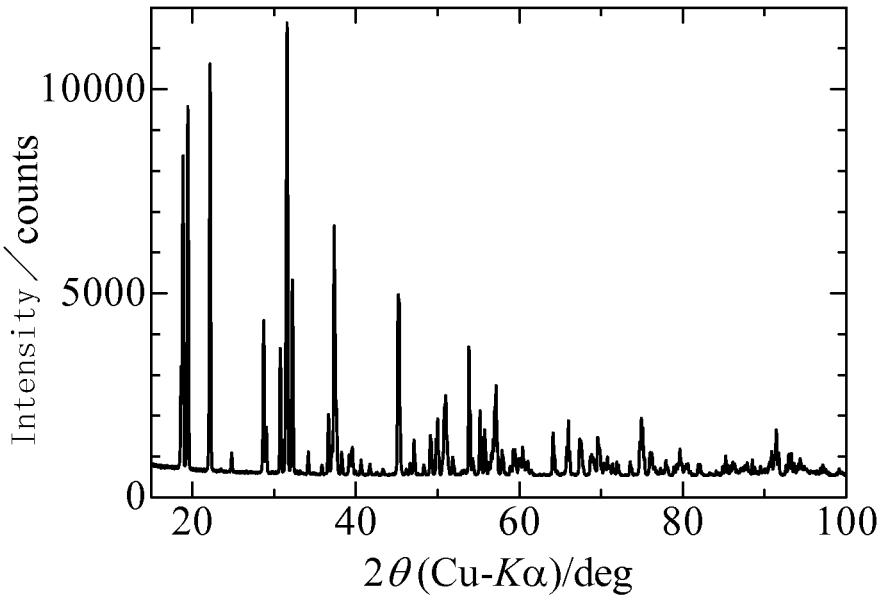
FIG. 4 An X-ray diffraction pattern of mixed powder after reaction obtained in Example 4.

FIG. 4 shows an X-ray diffraction pattern of the obtained powder, and Rietveld analysis confirmed that the powder was a mixture comprising $Ca_3WO_6$, $CaWO_4$, and CaO, at a weight ratio (%) of 62:8:30 ($Ca_3WO_6$:$CaWO_4$:CaO).

The results confirmed that a product containing $Ca_3WO_6$ and $CaWO_4$, which are tungsten-containing complex oxides, was obtained by the above heat treatment, and that tungsten was occluded in the product.

Example 5

Collection of Tungsten from Tungsten Foil Using $SrCO_3$ $SrCO_3$ powder (3 g) was placed in one of two ceramic containers, and tungsten foil (thickness: 0.035 mm, weight: 0.4 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1400° C. for 10 hours in air, the tungsten foil was evaporated, and white powder was obtained in the ceramic container that had contained $SrCO_3$ powder.

Figure 5:
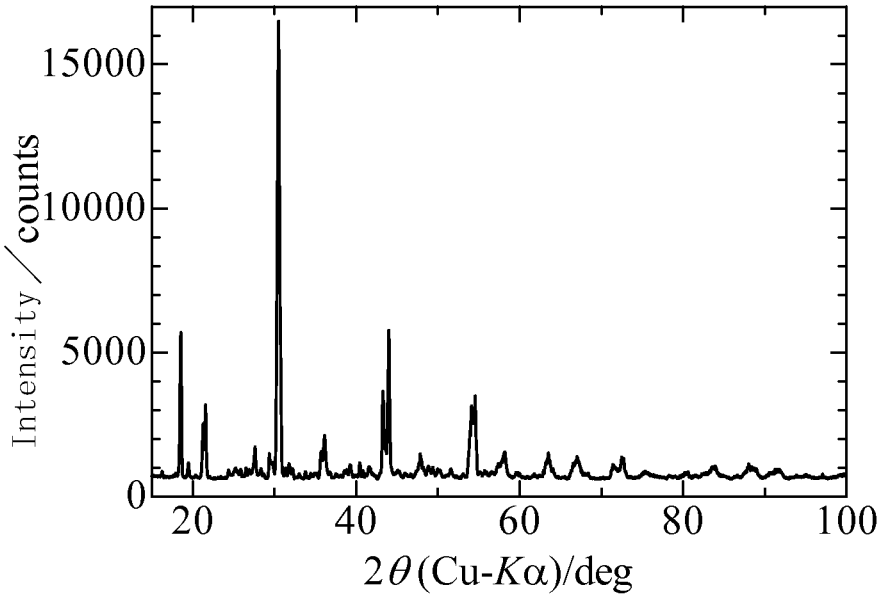
FIG. 5 An X-ray diffraction pattern of mixed powder after reaction obtained in Example 5.

FIG. 5 shows an X-ray diffraction pattern of the obtained powder, and Rietveld analysis confirmed that the powder was a mixture comprising $Sr_3WO_6$, $SrWO_4$, $Sr_2WO_5$, and $Sr(OH)_2$, at a weight ratio (%) of 72:15:5:8 ($Sr_3WO_6$:$SrWO_4$:$Sr_2WO_5$:$Sr(OH)_2$).

The results confirmed that a product containing $Sr_3WO_6$, $SrWO_4$, and $Sr_2WO_5$, which are tungsten-containing complex oxides, was obtained by the above heat treatment, and that tungsten was occluded in the product.

Example 6

Collection of Tungsten from Tungsten Foil Using $BaCO_3$ $BaCO_3$ powder (4 g) was placed in one of two ceramic containers, and tungsten foil (thickness: 0.035 mm, weight: 0.3 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1300° C. for 10 hours in air, the tungsten foil was evaporated, and colorless powder was obtained in the ceramic container that had contained $BaCO_3$ powder.

Figure 6:
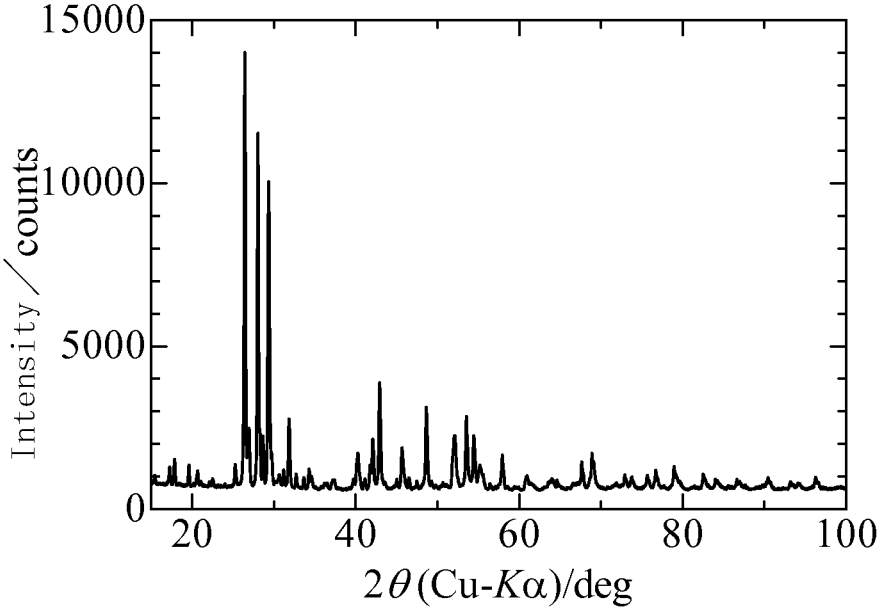
FIG. 6 An X-ray diffraction pattern of mixed powder after reaction obtained in Example 6.

FIG. 6 shows an X-ray diffraction pattern of the obtained powder, and Rietveld analysis confirmed that the powder was a mixture comprising $BaWO_4$, $Ba_3WO_6$, $Ba_2WO_5$, and $BaAl_2O_4$, at a weight ratio (%) of 46:25:20:9 ($BaWO_4$:$Ba_3WO_6$:$Ba_2WO_5$:$BaAl_2O_4$).

The results confirmed that a product containing $BaWO_4$, $Ba_3WO_6$, and $Ba_2WO_5$, which are tungsten-containing complex oxides, was obtained by the above heat treatment, and that tungsten was occluded in the product.

Example 7

Collection of Ruthenium from Ruthenium Dioxide Powder Using CaO

CaO powder (0.09 g) was placed in one of two ceramic containers, and ruthenium dioxide powder (0.2 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1200° C. for 10 hours in air, the ruthenium dioxide powder was partially evaporated, and black powder was obtained in the ceramic container that had contained CaO powder.

Figure 7:
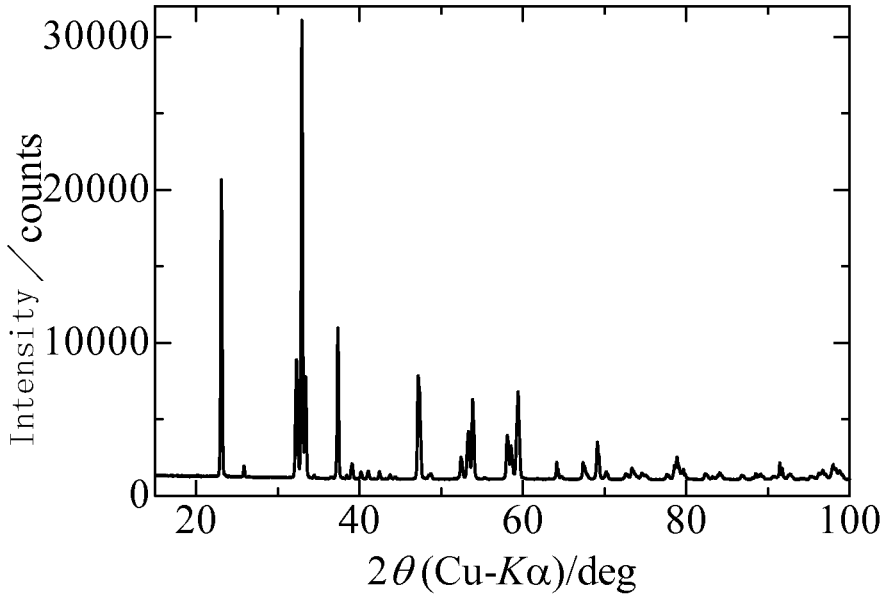
FIG. 7 An X-ray diffraction pattern of mixed powder after reaction obtained in Example 7.

FIG. 7 shows an X-ray diffraction pattern of the obtained powder, and Rietveld analysis confirmed that the powder was a mixture comprising $CaRuO_3$ and CaO at a weight ratio (%) of 72:28 ($CaRuO_3$:CaO).

The results confirmed that a product containing $CaRuO_3$, which is a ruthenium-containing complex oxide, was obtained by the above heat treatment, and that ruthenium was occluded in the product.

Example 8

Collection of Ruthenium from Ruthenium Powder Using $SrCO_3$ $SrCO_3$ powder (0.3 g) and ruthenium powder (0.2 g) were placed in a ceramic container (made of alumina, rectangular parallelepiped shape, volume: about 15 $cm^3$) in such a manner that the powders were not in contact each other, and the container was covered with the lid. Subsequently, by performing heat treatment at 1250° C. for 10 hours in air, the ruthenium powder was partially evaporated, and the $SrCO_3$ powder (colorless) turned black.

Figure 8:
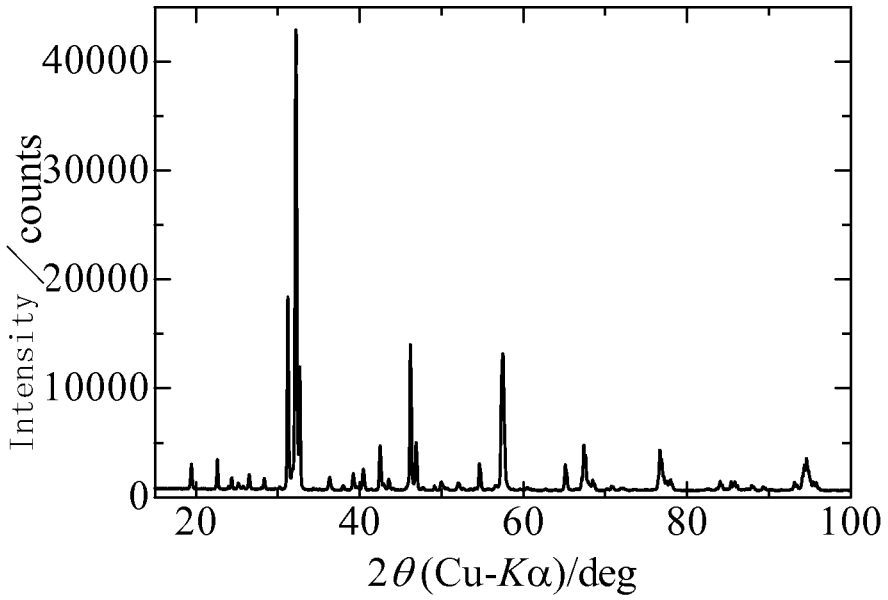
FIG. 8 An X-ray diffraction pattern of mixed powder after reaction obtained in Example 8.

FIG. 8 shows an X-ray diffraction pattern of the obtained powder, and Rietveld analysis confirmed that the powder was a mixture comprising $SrRuO_3$, $Sr_2RuO_4$, $Sr(OH)_2.H_2O$, and $SrCO_3$ at a weight ratio (%) of 55:30:13:2 ($SrRuO_3$:$Sr_2RuO_4$:$Sr(OH)_2.H_2O$:$SrCO_3$).

The results confirmed that a product containing $SrRuO_3$ and $Sr_2RuO_4$, which are ruthenium-containing complex oxides, was obtained by the above heat treatment, and that ruthenium was occluded in the product.

Example 9

Collection of Iridium from Iridium Foil Using $SrCO_3$ $SrCO_3$ powder (0.14 g) and iridium foil (0.03 g) were placed in a ceramic container (made of alumina, rectangular parallelepiped shape, volume: about 15 $cm^3$) in such a manner that the powder was not in contact with the foil, and the container was covered with the lid. Subsequently, by performing heat treatment at 1400° C. for 10 hours in air, the iridium foil was partially evaporated, and the $SrCO_3$ powder (colorless) turned black.

Figure 9:
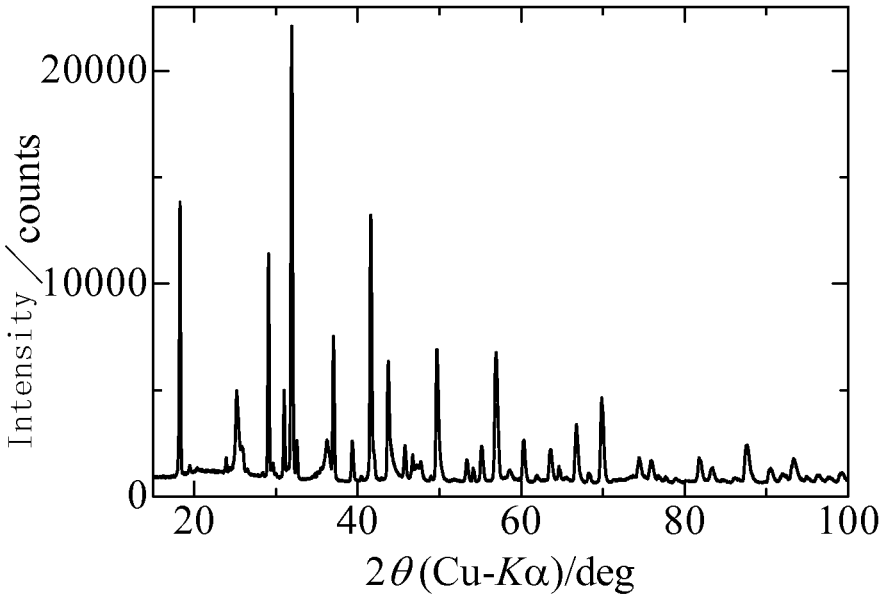
FIG. 9 An X-ray diffraction pattern of mixed powder after reaction obtained in Example 9.

FIG. 9 shows an X-ray diffraction pattern of the obtained powder, and Rietveld analysis confirmed that the powder was a mixture comprising $Sr_4IrO_6$, $Sr_2IrO_4$, $Sr(OH)_2.H_2O$, and $SrCO_3$ at a weight ratio (%) of 58:5:2:35 ($Sr_4IrO_6$:$Sr_2IrO_4$:$Sr(OH)_2.H_2O$:$SrCO_3$).

The results confirmed that a product containing $Sr_4IrO_6$ and $Sr_2IrO_4$, which are iridium-containing complex oxides, was obtained by the above heat treatment, and that iridium was occluded in the product.

Example 10

Collection of Rhenium and Tungsten from Rhenium-Tungsten Alloy Wire Using CaO

CaO powder (0.2 g) was placed in one of two ceramic containers, and rhenium-tungsten alloy wire (diameter: 1 mm, length: 35 mm, weight: 0.5 g, weight ratio (%) of rhenium:tungsten=25:75) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1375° C. for 10 hours in air, the rhenium-tungsten alloy wire was evaporated, and yellow powder was obtained in the ceramic container that had contained CaO powder.

Figure 10:
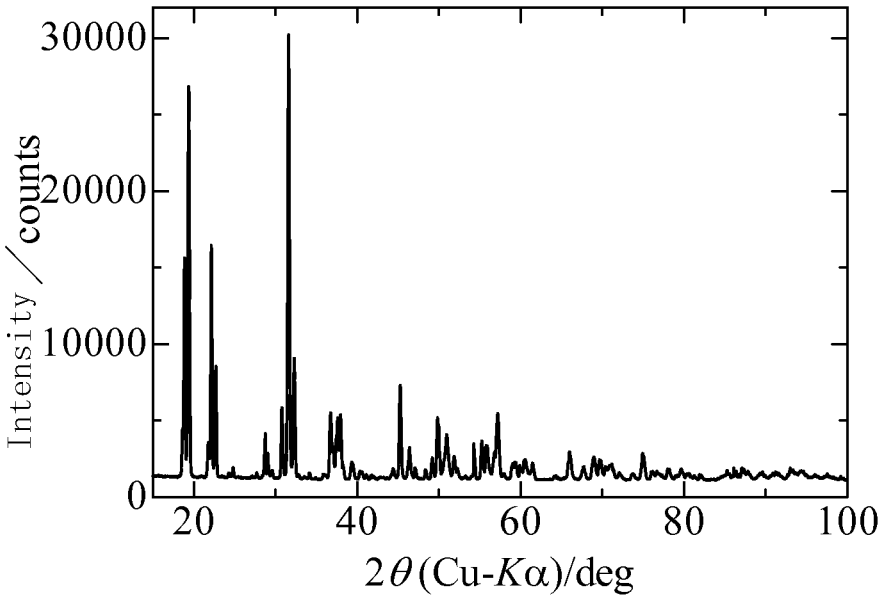
FIG. 10 An X-ray diffraction pattern of mixed powder after reaction obtained in Example 10.

FIG. 10 shows an X-ray diffraction pattern of the obtained powder, and Rietveld analysis confirmed that the powder was a mixture comprising $Ca_3ReO_6$, $Ca_{11}Re_4O_{24}$, and $CaWO_4$ at a weight ratio (%) of 61:35:4 ($Ca_3ReO_6$:$Ca_{11}Re_4O_{24}$:$CaWO_4$).

The results confirmed that a product containing $Ca_3ReO_6$ and $Ca_{11}Re_4O_{24}$, which are rhenium-containing complex oxides, and $CaWO_4$, which is a tungsten-containing complex oxide was obtained by the above heat treatment, and that rhenium and tungsten were occluded in the product.

Example 11

Collection of Molybdenum from Molybdenum Foil Using $La_2O_3$ $La_2O_3$ powder (0.7 g) was placed in one of two ceramic containers, and molybdenum foil (thickness: 0.035 mm, weight: 0.4 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1300° C. for 10 hours in air, the molybdenum foil was evaporated, and colorless powder was obtained in the ceramic container that had contained $La_2O_3$ powder.

Figure 11:
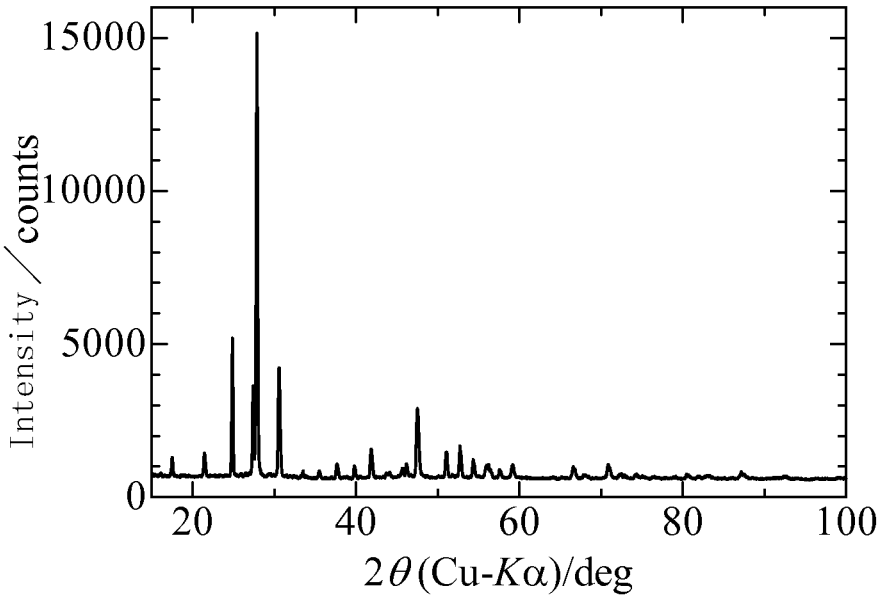
FIG. 11 An X-ray diffraction pattern of mixed powder after reaction obtained in Example 11.

FIG. 11 shows an X-ray diffraction pattern of the obtained powder, and Rietveld analysis confirmed that the powder was a mixture comprising $La_2Mo_2O_9$ and $La_2MoO_6$ at a weight ratio (%) of 91:9 ($La_2Mo_2O_9$:$La_2MoO_6$).

The results confirmed that a product containing $La_2Mo_2O_9$ and $La_2MoO_6$, which are molybdenum-containing complex oxides, was obtained by the above heat treatment, and that molybdenum was occluded in the product.

Example 12

Collection of Indium from Indium Oxide Powder Using $La_2O_3$ $La_2O_3$ powder (0.5 g) was placed in one of two ceramic containers, and indium oxide powder (0.5 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1500° C. for 10 hours in air, the indium oxide powder was partially evaporated, and colorless powder was obtained in the ceramic container that had contained $La_2O_3$ powder.

Figure 12:
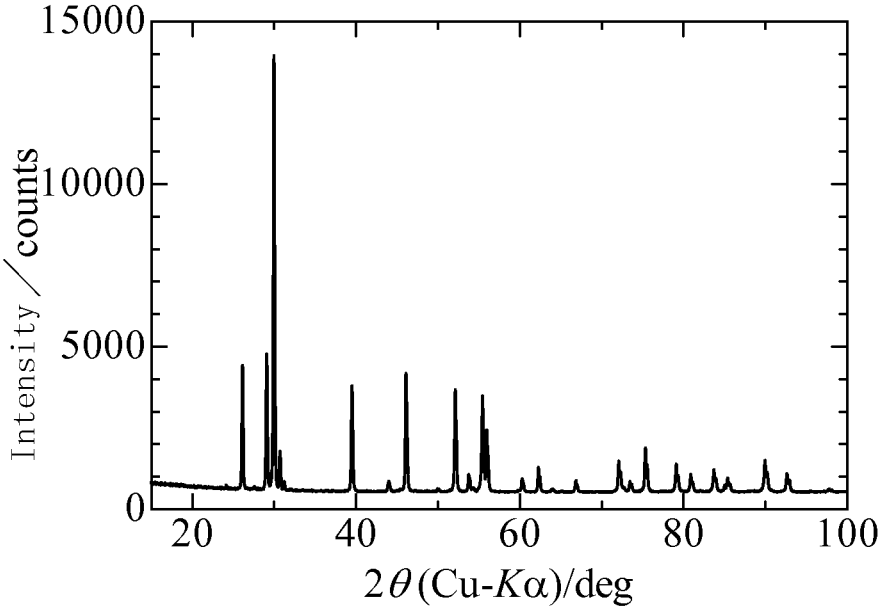
FIG. 12 An X-ray diffraction pattern of mixed powder after reaction obtained in Example 12.

FIG. 12 shows an X-ray diffraction pattern of the obtained powder, and Rietveld analysis confirmed that the powder was a mixture comprising $LaInO_3$ and $La_2O_3$ at a weight ratio (%) of 9:91 ($LaInO_3$:$La_2O_3$).

The results confirmed that a product containing $LaInO_2$, which is an indium-containing complex oxide, was obtained by the above heat treatment, and that indium was occluded in the product.

Example 13

Collection of Indium from Indium Oxide Powder Using $SrCO_3$ $SrCO_3$ powder (1.0 g) was placed in one of two ceramic containers, and indium oxide powder (0.5 g) was placed in the other ceramic container. The ceramic containers (made of alumina, rectangular parallelepiped shape, volume: about 15 $cm^3$) each have the same dimensions. Thereafter, these two containers were placed in a ceramic container (made of alumina, rectangular parallelepiped shape, volume: about 400 $cm^3$), and the container was covered with the lid. Subsequently, by performing heat treatment at 1450° C. for 10 hours in air, the indium oxide powder was partially evaporated, and colorless powder was obtained in the ceramic container that had contained $SrCO_3$ powder.

Figure 13:
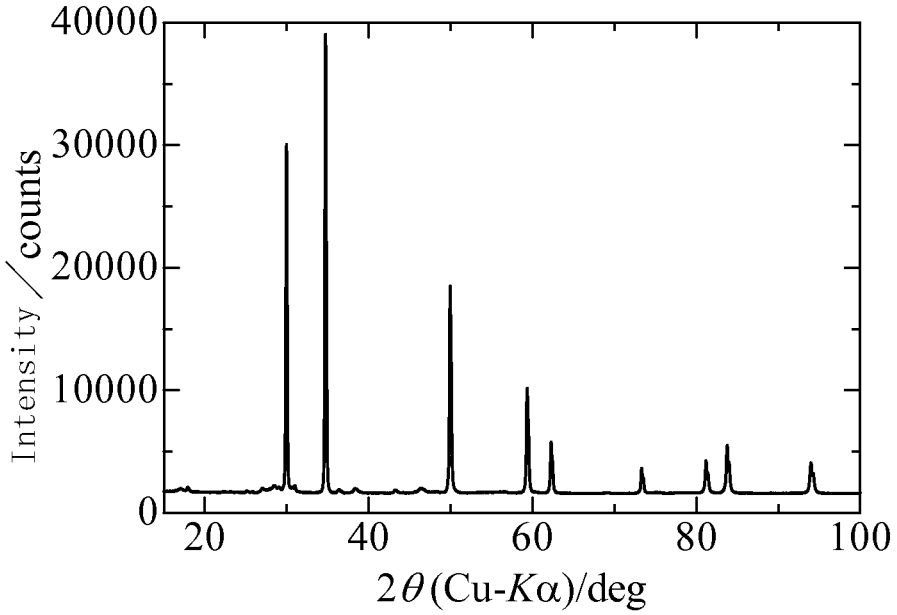
FIG. 13 An X-ray diffraction pattern of mixed powder after reaction obtained in Example 13.

FIG. 13 shows an X-ray diffraction pattern of the obtained powder, and Rietveld analysis confirmed that the powder was a mixture comprising $Sr_2In_2O_5$, SrO, $Sr(OH)_2$, and $SrCO_3$ at a weight ratio (%) of 1:86:12:1 ($Sr_2In_2O_5$:SrO:$Sr(OH)_2$:$SrCO_3$).

The results confirmed that a product containing $Sr_2In_2O_5$, which is an indium-containing complex oxide, was obtained by the above heat treatment, and that indium was occluded in the product.

The invention claimed is:

1. A method for collecting one or more metal components from a metal component-containing material, the method comprising heating the metal component-containing material and a metal component collection agent in such a manner that a metal vapor or metal oxide vapor produced by heating the metal component-containing material is brought into contact with the metal component collection agent, wherein the metal component collection agent comprises as an active ingredient a compound containing one or more group 2 elements of the periodic table, or a compound containing one or more lanthanoid elements.

2. The method according to claim 1, wherein the metal component-containing material and the metal component collection agent are placed together in one container and heated.

3. The method according to claim 1, wherein the metal component-containing material is a waste material containing at least one metal element selected from the group consisting of noble metal elements and rare metal elements, wherein the waste material is at least one material selected from the group consisting of waste catalysts for purifying automobile exhaust gas, waste catalysts for chemical industries, waste gas sensor boards, wastes generated in electronic circuit board manufacturing processes, waste electronic components, wastes of electrolysis electrodes and, wastes generated from medical products;

wherein the noble metal elements and rare metal elements are metal elements in groups 6, 7, 8, 9 and 13 of the periodic table.

4. A method for recovering metal, comprising:

collecting one or more metal components using the method of claim 1;

dissolving the collected one or more metal elements in an acid; and then recovering the dissolved one or more metal elements as a solid metal.

* * * * *